US006202356B1

(12) United States Patent
Hock

(10) Patent No.: US 6,202,356 B1
(45) Date of Patent: Mar. 20, 2001

(54) MULTIFUNCTIONAL BUILDING

(76) Inventor: Frans Hock, Maanstraat 4, 2310 Rijkevorsel (BE)

( * ) Notice: Subject to any disclaimer, the term of this patent is extended or adjusted under 35 U.S.C. 154(b) by 0 days.

(21) Appl. No.: 09/024,568

(22) Filed: Feb. 17, 1998

Related U.S. Application Data

(63) Continuation-in-part of application No. PCT/NL96/00329, filed on Aug. 19, 1996.

(30) Foreign Application Priority Data

Aug. 18, 1995 (NL) ..... 1001005

(51) Int. Cl.[7] ..... E04H 3/10; E04H 3/28; E04H 3/26; E04B 1/343

(52) U.S. Cl. ..... 52/6; 52/7; 52/9; 52/66; 52/126.6; 472/92

(58) Field of Search ..... 52/6, 7, 126.6, 52/66, 9, 10, 64; 472/92, 136

(56) References Cited

U.S. PATENT DOCUMENTS 3,975,869 8/1976 Bouton ..... 52/9
4,783,934 * 11/1988 Langhart et al. ..... 52/64
5,319,895 * 6/1994 Ray ..... 52/7 X
5,365,704 * 11/1994 Ray ..... 52/7 X
5,468,190 * 11/1995 McCaffrey ..... 52/7 X
5,642,589 * 7/1997 Miron et al. ..... 52/7
5,921,032 * 7/1999 Labinski ..... 52/10 X

FOREIGN PATENT DOCUMENTS

WO 90/15207 12/1990 (WO) ..... E04H/3/10

* cited by examiner

*Primary Examiner*—Robert Canfield
(74) *Attorney, Agent, or Firm*—McCutchen, Doyle, Brown & Enersen

(57) ABSTRACT

A multifunctional building for providing accomodation to events, said building comprising a sports field (1) for an outdoor sport, whereby at least part of the sports field is provided in a container (4) which can be moved in vertical direction, in such a manner that in raised condition said container forms the roof of a space which can be utilized for indoor activities. The sports field may be a grass field which comprises sports facilities fixedly provided thereon. Stands (6) may be present outside the sports field, which stands can be moved to a position under the container when the container occupies a raised position. Roofed-in stands may furthermore be present, the roof of said stands abutting the container when said container occupies a raised position.

17 Claims, 3 Drawing Sheets

MULTIFUNCTIONAL BUILDING

This application is a continuation-in-part of PCT/NL96/00329 filed Aug. 19, 1996.

MULTIFUNCTIONAL BUILDING

The invention relates to a multifunctional building for providing accommodation to events, said building comprising a sports field for an outdoor sport, at least part of the sports field being provided in a container, means for moving said container in vertical direction, all in such a manner that in raised condition said container forms the roof of a space which can be utilized for indoor activities. The outdoor sport can be soccer, baseball, rugby, American football, etc.

Such a building is known from WO-A-90/15207. The building according to WO-A-90/15207 comprises piers on the corners of the container for guiding the container during the vertical movement thereof.

The present invention provides an improved multifunctional building which is characterized in that said means for moving said container in vertical direction are provided under said container.

As a result of this said means do not constitute a physical or visual obstacle when the container occupies a low position. In addition this enables an advantageous support with a minimum span and an optimum distribution of forces.

With a building of this type the sports field for practicing the outdoor sport always lies in the open air, so that the rules of the sport in question are complied with. According to another aspect of the invention the sports field may furthermore consist of natural grass, which grass can be kept in optimum condition, because it is in contact with the outside air and with the natural light at all times, whilst in addition to that the quality of the grass may be enhanced in that the container in which the grass field is present may be provided with the necessary installations for the watering, draining, etc. of the grass field. Furthermore heating elements may be provided in order to prevent snow and/or ice from remaining present on the sports field, which is disadvantageous when the sports field is being used and which is also disadvantageous because of the additional energy which would be required for moving the sports field in vertical direction.

According to another aspect of the invention the sports field may comprise sports facilities fixedly provided thereon, such as dugouts, goal posts, lines, etc. When indoor activities take place these sports facilities do not cause any inconvenience, because they are present on the roof of the space within which the indoor activities take place.

According to another aspect of the invention stands which are present outside the sports field may be movable in such a manner that they can be moved to a position under the container when said container occupies a raised position. In that case the container comprising the sports field not only forms the roof of the space within which an indoor activity takes place, but it also forms the roof of the stand that has been moved forward. This may be advantageous in particular when the indoor activity is a sport which is played on a smaller area than the area of the sports field.

According to another aspect of the invention roofed-in stands may be present outside the sports field, the roof of said stands being constructed in such a manner that it abuts the container when said container has been moved to a raised position. In this manner it is possible to form a closed space having a free area of at least the same dimensions as the sports field.

According to another aspect of the invention the container, when occupying its raised position, may abut a wall or the roof of a stand, whereby a flexible, inflatable sealing means is provided between said container and said wall or said roof. Preferably said sealing means consists of a flexible, inflatable hose, which may be divided into compartments. The hose may thereby be inflated when the container is positioned at the correct height, so that an adequate yet slightly flexible seal is obtained along the edge of the container.

According to another aspect of the invention said sealing means are attached to the container and they are at the upper side provided with a slab whose bottom edge extends to above a wall part or said roof after said sealing means have been inflated. As a result of this it is inter alia possible to obtain an adequate discharge of for example rain water. This construction will be explained in more detail hereafter.

According to another aspect of the invention the container may be provided with a supporting structure, which has a height such that it comprises a floor, so that a space is created which may function as a parking garage or a storage space. In this manner the height of the container and its supporting structure which is necessary to give the container sufficient strength and rigidity can be utilized in an effective manner.

Of course such a parking garage for visitors of events can only be used when the container occupies its lowermost position. The storage space can be used constantly, however, for example as a caravan garage. The space may thereby be accessible in more than one raised position of the container.

According to another aspect of the invention the container may be constructed in such a manner that it can be secured in a user position at several heights, which may be useful, for example for energy reasons, when events take place which require a space less high than the maximum height to which the container can be raised. In one preferred embodiment this maximum height may be higher than the roof of the stands surrounding the sports field, as a result of which the number of possible uses of the building can be further increased.

According to another aspect of the invention at least three hydraulic jacks are provided under the container for lifting said container, whereby each jack may comprise a plurality of hydraulic cylinders surrounding a leg, on which leg the container is supported, and whereby said cylinders are capable of jointly moving said leg some distance upwards, and whereby one cylinder can engage said leg at a lower location whilst another cylinder remains in engagement with said leg. This will be discussed in more detail hereafter by means of an embodiment of a jack of this type.

The number of hydraulic jacks and/or their location is preferably selected such that the space under the container can be utilized optimally and that they do not form an obstacle when the stands are being moved, as already discussed before. It is preferred to use four jacks, which are spaced far apart.

Furthermore the invention relates to a method for converting a facility for practising an outdoor sport into a facility for indoor activities, and vice versa, wherein at least part of the bottom of the sports field for said outdoor sport is moved up to the position in which said bottom forms the roof of the space for said indoor activities, and vice versa.

Further aspects of the invention, which may be used both separately and in combination with each other, are described hereafter and are defined in the claims. Hereafter an embodiment of a multifunctional building will be described by way of illustration with reference to the drawing.

The Figures are merely schematic illustrations of the building and parts thereof, wherein like parts are numbered alike.

Figure 2:
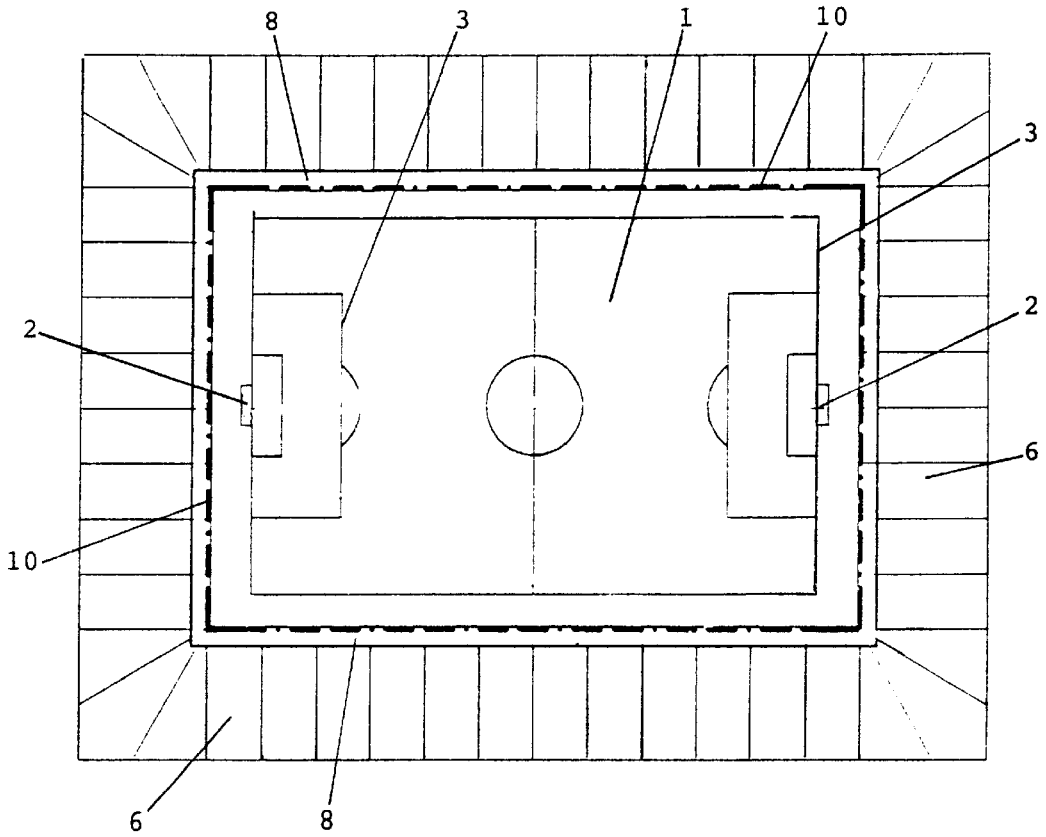
FIG. 2 is a plan view of the building.
Figure 1:
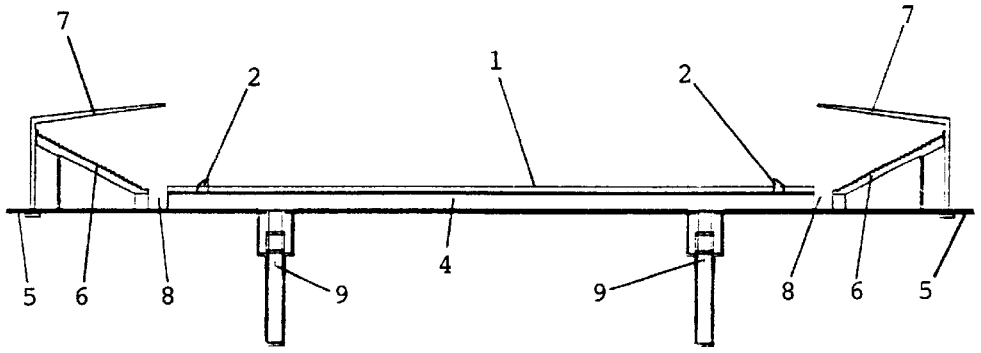
FIG. 1 shows the building in sectional view.

The schematic sectional view of FIG. 1 shows a sports field 1 in the form of a soccer field with natural grass, which sports field 1 is provided with sports facilities such as goals 2 and lines 3 (FIG. 2). The sports field 1 is present within a container 4, which, in order to have sufficient rigidity for supporting the sports field, has a height of a few meters, including its supporting structure.

In the situation shown in FIG. 1 container 4 is positioned on or near the ground 5 (surface level), that is, in its lowermost position.

Provided around the sports field 1 are stands 6 with seating accommodation for spectators. A roof 7 is present over stand 6, so that the spectators on stand 6 are sheltered. A safety trench 8 is present between container 4 and stands 6, which safety trench functions to prevent spectators from having easy access to the sports field 1 from stand 6. The depth of safety trench 8 is equal to the height of container 4 in this embodiment.

In the embodiment illustrated in FIG. 1 container 4 is supported by four jacks 9, two of which are shown in FIG. 1. Container 4, with sports field 1 present therein, can be raised to various heights by means of said hydraulic jacks 9.

FIG. 2 is a plan view of the building, from which the roof 7 of stands 6 has been left out. As a result of this stands 6 and safety trench 8 can be distinguished. The periphery of sports field 1, which measures 120 meters by 79, for example, is indicated by means of chain-dotted line 10. The sports field 1 is provided with the lines 3 for a soccer match. The dimensions of said soccer field are 105 meters by 68.

Figure 3:
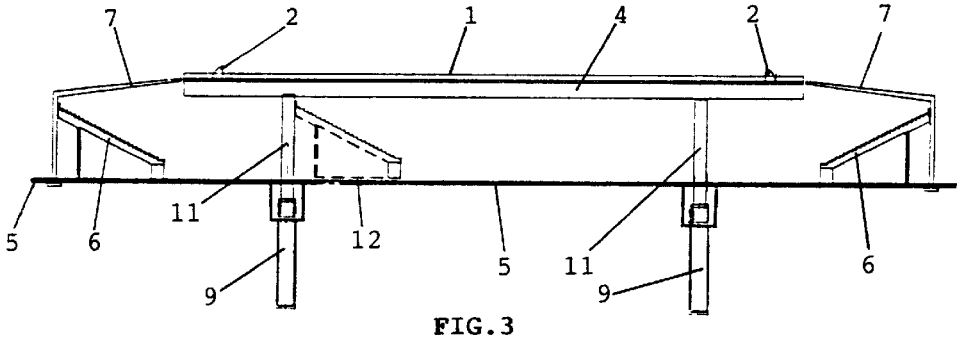
FIG. 3 is a sectional view of the building.

FIG. 3 is a schematic sectional view of the building, wherein container 4 with sports field 1 occupies a raised position. Container 4 is thereby supported on four legs 11, two of which are shown. Said legs 11 have been raised by means of jacks 9, and that in such a manner that the edge of container 4 is positioned near roof 7 of stand 6.

Legs 11 move up and down along with the container and are hidden in the ground when container 4 occupies a low position. Legs 11 may thereby be provided spaced from the edge of container 4, so that an advantageous support of the container with a minimum span and an optimum distribution of forces is obtained.

The space between container 4 and root 7 may be filled, as will be explained in more detail hereafter, so that a closed space is created under container 4 and roof 7, in which events such as sporting contests for indoor sports and pop concerts may take place.

In the embodiment the stands 6 along the short sides of sports field 1 are constructed in such a manner that they can be moved to a position under container 4, so that a smaller space is created between stands 6. This may be of importance for sporting contests such as tennis, which are plated on a smaller area than a soccer match. The forward position of the stands is indicated at 12.

Figure 4:
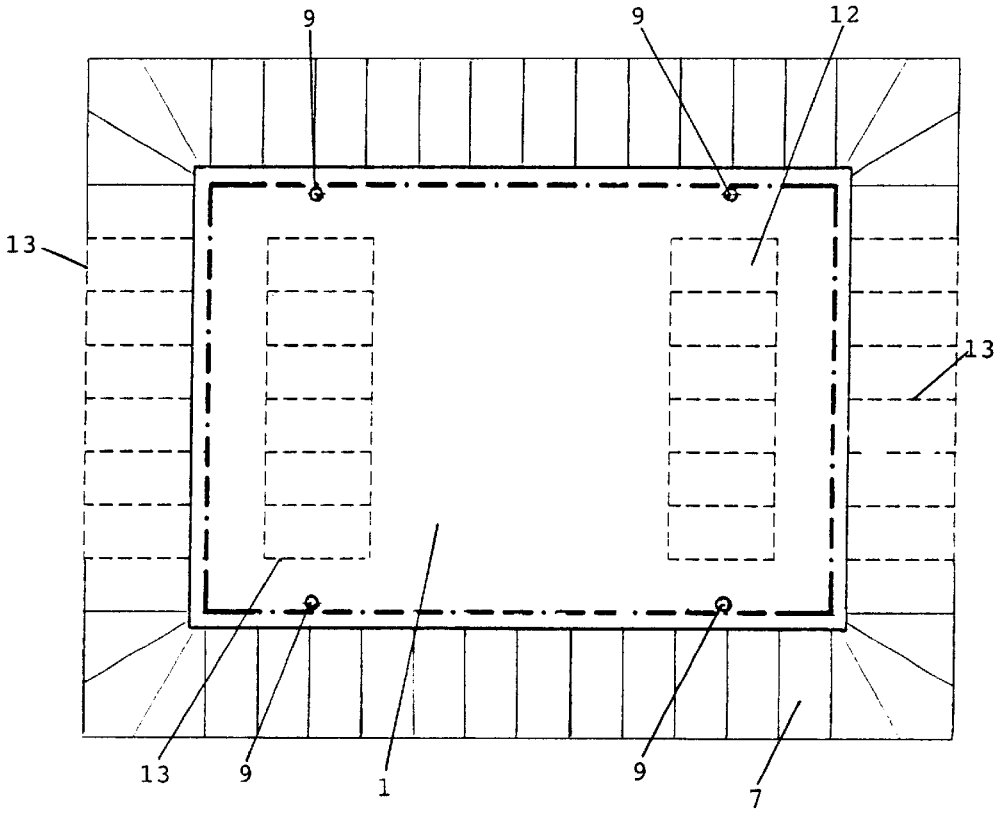
FIG. 4 is a plan view of the building.

FIG. 4 shows a plan view which corresponds with FIG. 2, from which also container 4 has been left out. Chain-dotted line 10 indicates the periphery of the sports field 1, and dashed lines 13 indicate the positions of stands 6, both in their normal position and in their forward position. In addition to that FIG. 4 shows the four lacks 9.

The weight of the container with the sports field may be 10 kg, for example. The space between container 4 and the roof (FIG. 3) may be 0.5 m, for example.

Figure 5:
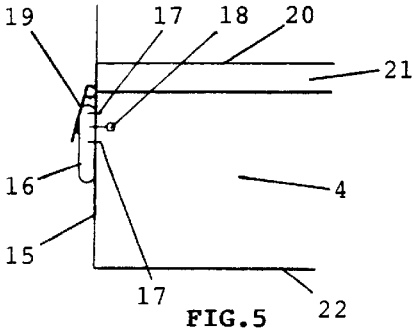
FIG. 5 shows part of the container with sealing means.

FIG. 5 schematically shows the edge of container 4, which consists of the vertical side 15. Said vertical side 15 has a height of 3 m, for example, and is provided with a flexible hose 16 surrounding container 4. In its position of rest said hose 16 may for example have a shape as illustrated in FIG. 5. Said hose is attached to container 4 at the locations indicated at 17. A pressure pipe 18 is present within container 4, by means of which pressure pipe hose 16 can be inflated. Hose 16 may be subdivided into compartments, whereby each compartment may be connected to pressure pipe 18. A slab 19 of a flexible material, for example rubber, is provided above and against hose 16. Said slab is hinged to container 4 at its upper side, so that slab 19 will be pressed outwards when hose 16 is inflated.

Figure 6:
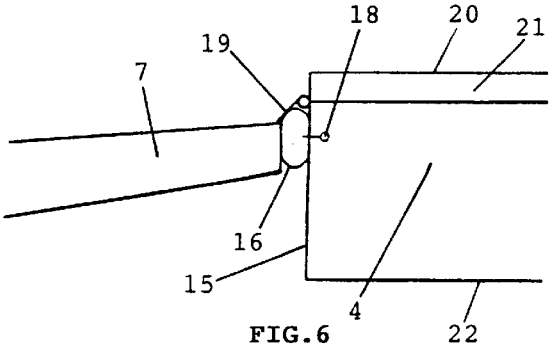
FIG. 6 shows the operation of the sealing means.

FIG. 6 shows the side 15 of container 4 in its position near roof 7 of the stand. The space between roof 7 and container 4 is 0.5 m, for example, and is sealed by inflating hose 16 by means of pressure pipe 18. As is apparent from FIG. 6, slab 19 is thereby lifted, so that its bottom edge will be positioned above roof 7. As a result of this rain water and the like can readily flow off from sports field 1 to the upper side of roof 7. Thus the resulting seal between container 4 and roof 7 is fully weather resistant and yet flexible to a certain extent.

Figure 7:
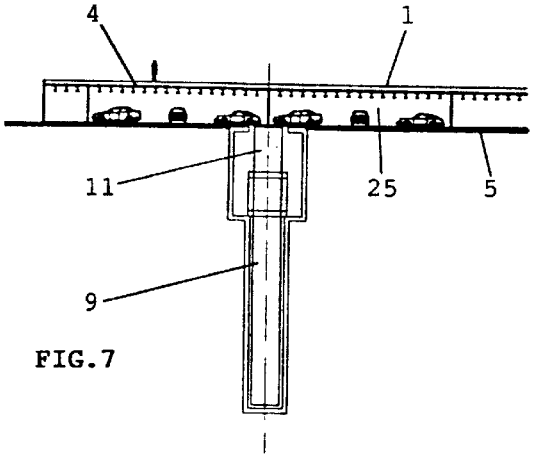
FIG. 7 shows part of the container, with a parking garage present therein.

FIG. 7 schematically illustrates part of container 4, showing the space 25 which has been created within container 4. In order to give container 4, which supports sports field 1, sufficient rigidity and strength, container 4 is constructed to have a height of a few meters, 3 or 4 for example, which makes it possible to create a circumferentially closed space 25 within container 4. FIG. 7 shows the container in its lowermost position, and space 25 is in the form of a garage for about 400 passenger cars.

Figure 8:
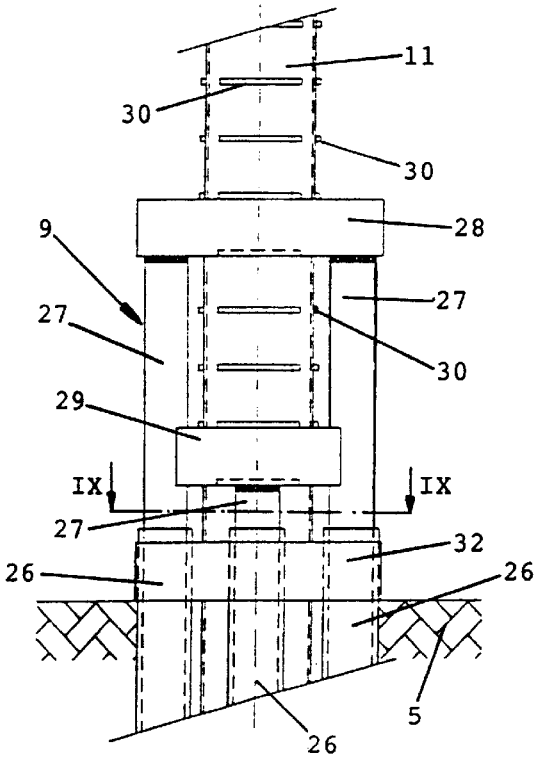
FIG. 8 is an elevational view of a jack.

FIG. 8 is a schematic view of a jack 9, which is provided with four hydraulic cylinders 26, which are capable of moving a leg 11 upwards. The pistons 27 of two opposing cylinders 26 are to that end interconnected by a yoke 28, 29 at their upper sides, which yoke can be moved in vertical direction by the cylinders 26 in question.

Leg 11 has a substantially square cross-section and consists of a metal shell, which may be filled with concrete. Cams 30 are welded to the metal shell of leg 11 in a predetermined spaced-apart relationship. Said cams 30 are positioned on all four sides of leg 11. Leg 11 is at its upper side attached to container 4. Jack 9 is located under the ground 5 (surface level), as is for example shown in FIG. 7.

Figure 9:
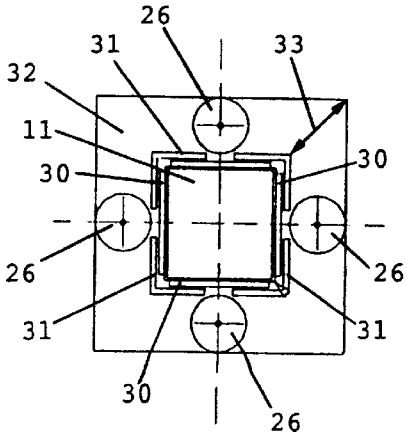
FIG. 9 is a sectional view, along line IX—IX in FIG. 8.

FIG. 9 is a schematic view according to line IX—IX in FIG. 8. Four cylinders 26 are shown, which are each positioned near a flat side of leg 11. Furthermore four locking means 31 are provided, which can be moved in a horizontal plane from a free position, as shown in FIG. 9, to a locking position, in which position locking means 31 butts against leg 11. Said locking means 31 are secured to foundation plate 32, in which cylinders 26 are provided, so that leg 11 is locked against movement in vertical direction when locking means 31 occupy their locking position. Arrow 33 indicates the direction of movement of locking means 31.

Figure 10:
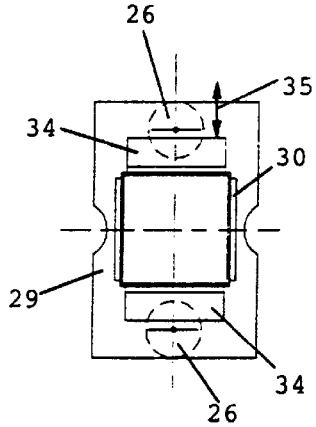
FIG. 10 is a plan view of the first yoke.

FIG. 10 is a schematic plan view of first yoke 29, which is secured to two pistons of opposing hydraulic cylinders 26. The lower yoke 29 is provided with two locking means 34, which are capable of movement in horizontal direction with respect to yoke 29, as indicated by arrow 35. Locking means 34 can move from a locking position, in which they butt against leg 11, to a free position, in which they are spaced from leg 11, and vice versa. In the locking position locking means 34 co-operate with cams 30.

Figure 11:
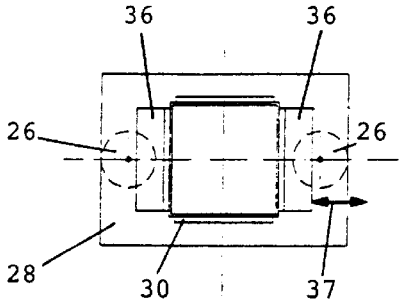
FIG. 11 is a plan view of the second yoke.

FIG. 11 is a schematic clan view of the upper yoke 28, showing the two other opposing hydraulic cylinders 26.

Upper yoke 28 is likewise provided with locking means 36, which function in the same manner as locking means 34 of lower yoke 29. The direction of movement of locking means 36 is indicated by means of arrow 37.

The operation of the hydraulic jack 9 is as follows. When container 4 is to be moved up from its lowermost position, the two yokes 28, 29 are in their lowermost position, one being positioned straight above the other, so that the locking means 36, 34 provided on yokes 28, 29 are in engagement with cams positioned one above the other. Locking means 34, 36 are to that end in their locking position, in which they butt against leg 11. Locking means 31 located on the four corner points of leg 11, at the upper side of foundation plate 32, are moved to their free position as shown in FIG. 9 when the lifting operation is to begin. Then leg 11 is moved upwards by the action of all four hydraulic cylinders 26. The diameter of hydraulic cylinder 26 is for example 0.7 m, whilst the hydraulic pressure is for example 400 bar. The velocity at which leg 11 is moved is 2 m per hour, for example.

When yokes 28, 29 have reached their uppermost position, that is, when the hydraulic cylinders have completed their maximum stroke of for example 1.5 m, locking means 31 are moved to their locking position, thus blocking any downward movement of leg 11. Then locking means 34 of the lower yoke 29 are put in their free position, to that the lower yoke 29 can be moved down to its starting position. In that position locking means 34 are out in their locking position again, so that they come into engagement with the relevant cams 30.

Then locking means 36 of upper yoke 28 are put in their free position, after which upper yoke is moved to its lowermost position as well. Then locking means 36 are put in their locking position again. After locking means 31 have been put in their free position, the moving upwards of leg 11 along the length of stroke of hydraulic cylinders 26 can be started again.

It will be apparent that by using the above method a double locking of leg 11 is provided at all times, that is, at least two of the three sets of locking means 31, 34, 36 are constantly in engagement with the cams 30 of leg 11. This is important for safety reasons, in particular when the space under container 4 is being used during said lifting.

The downward movement of leg 11 is effected by the same method, during which movement two of the three sets of locking means 31, 34, 36 are likewise constantly in engagement with leg 11.

By using the multifunctional building according to the present invention it becomes possible to use a relatively small ground area in a very efficient manner. Furthermore it is possible to keep a field of grass forming sports field 1 in an optimum condition, because it lies in the open air at all times and because it can be kept free from contact with sportspeople for a desired period of time. Under normal circumstances the time required for lifting or lowering the sports field may be 4 to 8 hours, this may take place at night, for example.

The illustrated embodiment is merely to be considered as such. The invention as described above may also be implemented in manners different from that according to the illustrated embodiment.

What is claimed is:

1. A multifunctional building for providing accommodation to events, the building comprising a sports field for outdoor sport, wherein at least part of the sports field is provided upon a container, wherein the building comprises:

a sports field;

a container; and means for moving the container in a vertical direction, wherein the moving means are provided under the container;

wherein the container forms a roof of a space that can be utilized for indoor activities when the container is in a raised position.

2. The building of claim 1, wherein the sports field comprises sports facilities fixed upon the sports field.

3. The building of claim 1, wherein stands are present outside the sports field, wherein the stands can be moved under the container when the container is in a raised position.

4. The building of claim 1, wherein roofed-in stands, comprising at least one roof, are present outside the sports field, wherein at least one roof abuts the container when the container is in a raised position.

5. The building of claim 4 wherein a flexible, inflatable seal can be interposed between the container and the roof when the container is in a raised position.

6. The building of claim 5 wherein the flexible, inflatable seal comprises a flexible, inflatable hose, preferably divided into compartments.

7. The building of claim 5, wherein the seal is attached to the container and is provided with a slab with a bottom edge that extends to above at least one wall of the building after the seal has been inflated.

8. The building of claim 1, wherein at least one wall abuts the container when the container is in a raised position.

9. The building of claim 8, wherein a flexible, inflatable seal can be interposed between the container and the wall.

10. The building of claim 9, wherein the flexible, inflatable seal comprises a flexible, inflatable hose, preferably divided into compartments.

11. The building of claim 1, wherein the container has a supporting structure and a space is provided in the supporting structure of the container, wherein the space comprises a floor and may function as a parking garage or storage space.

12. The building of claim 1, wherein at least three hydraulic jacks are provided under the container for lifting the container.

13. The building of claim 12, wherein the container has an edge and the hydraulic jacks are spaced from the edge of the container.

14. The building of claim 13, wherein each hydraulic jack comprises a plurality of hydraulic cylinders and a leg, wherein the hydraulic cylinders surround the leg and the leg supports the container.

15. The building of claim 14, wherein the hydraulic cylinders are capable of jointly moving the leg some distance upwards, and whereby one cylinder can reengage the leg at a different position on the leg while another cylinder remains engaged with the leg.

16. A method for converting an outdoor activity facility into an indoor activity facility comprising moving at least part of the bottom of a sports field for an outdoor activity provided upon a container up to a position in which the bottom forms a roof over a space for an indoor activity, wherein means for moving the sports field in a vertical direction are provided under the container.

17. A method for converting an indoor activity facility into an outdoor activity facility, wherein at least a part of the bottom of a sports field for an outdoor activity is provided upon a container and is in a raised position which forms a roof over a space for the indoor activity, comprising lowering said at least part of the bottom of the sports field for the outdoor activity down to a lowermost position on or near ground level, wherein means for lowering the sports field in a vertical direction are provided under the container.

* * * * *